US010674887B2

(12) United States Patent
Riancho

(10) Patent No.: US 10,674,887 B2
(45) Date of Patent: Jun. 9, 2020

(54) MAINTENANCE ITEM AND A CLEANING DEVICE INCLUDING SUCH A MAINTENANCE ITEM

(71) Applicant: DECITEX, Givenchy les la Bassee (FR)

(72) Inventor: Nils Riancho, Hellemmes (FR)

(73) Assignee: DECITEX, Givenchy les la Bassee (FR)

( * ) Notice: Subject to any disclaimer, the term of this patent is extended or adjusted under 35 U.S.C. 154(b) by 645 days.

(21) Appl. No.: 14/331,237

(22) Filed: Jul. 15, 2014

(65) Prior Publication Data

US 2016/0015235 A1 Jan. 21, 2016

(51) Int. Cl.
*A47L 13/16* (2006.01)

(52) U.S. Cl.
CPC ..... *A47L 13/16* (2013.01)

(58) Field of Classification Search
CPC ..... A47L 13/16; A47L 13/40; D04H 1/00; D04H 1/10; Y10T 428/24942; Y10T 428/24612; Y10T 428/24992; Y10T 428/26; Y10T 428/25; Y10T 428/24463; Y10T 442/659; Y10T 428/23936; B32B 2432/00; B32B 7/02; B29C 47/065
USPC ..... 428/85–97, 212–220, 57–62; 15/208; 442/341
See application file for complete search history.

(56) References Cited

U.S. PATENT DOCUMENTS 5,804,274 A * 9/1998 Nordin ..... A47L 13/16 428/89
7,451,516 B2 * 11/2008 Tanaka ..... A47L 13/20 15/208
7,578,023 B2 * 8/2009 Olson ..... A47L 13/16 15/208
2003/0021944 A1 * 1/2003 Morin ..... A47L 13/16 428/89
2005/0120497 A1 * 6/2005 Lynde ..... A47L 13/20 15/104.94
2011/0197917 A1 * 8/2011 Koptis ..... A46B 11/001 134/6
2012/0042467 A1 * 2/2012 Mandhai ..... A47L 13/16 15/209.1

FOREIGN PATENT DOCUMENTS

DE 10327584 A1 1/2005
WO 98/11290 A1 3/1998
WO WO-2009082136 A1 * 7/2009 ..... A47L 13/16

OTHER PUBLICATIONS

Celanese Complete Textile Glossary, 2001, Celanese Acetate LLC, New York, pp. 43, 44 and 160.*

* cited by examiner

*Primary Examiner* — Jenna L Johnson
(74) *Attorney, Agent, or Firm* — MH2 Technology Law Group, LLP

(57) ABSTRACT

A maintenance item for cleaning a floor includes a front portion and a rear portion in line with each other and having respective top and bottom faces. The bottom faces define a "cleaning" surface, the front portion includes, projecting from its bottom face, microfibers and scraping fibers of linear density greater than 1 dtex, and the rear portion includes, projecting from its bottom face, microfibers, and possibly also scraping fibers of linear density greater than 1 dtex. The mean linear density T1 (dtex) of the microfibers and of the scraping fibers on the bottom face of the front portion may be greater than or equal to 0.5 dtex, and the mean linear density T2 (dtex) of the microfibers, and optionally of the scraping fibers, on the bottom face of the rear portion may be less than or equal to 2 dtex. In addition, T1 may be different from T2.

19 Claims, No Drawings

MAINTENANCE ITEM AND A CLEANING DEVICE INCLUDING SUCH A MAINTENANCE ITEM

TECHNICAL FIELD

The present disclosure relates to the technical field of maintenance items for cleaning floor surfaces, and to cleaning devices for using such maintenance items.

BACKGROUND OF THE DISCLOSURE

When it is desired to clean a floor surface, it is known to use maintenance items that have on their "cleaning" bottom surface a textile made up of loops and/or a pile of microfibers and of fibers having a linear density greater than 1 dtex, also referred to by the term "scraping fibers". Microfibers are known for forming an extremely dense capillary array giving them excellent ability to absorb liquids and good ability to recover small particles such as dust. In the present text, the term "microfibers" is used to designate any fibers having a linear density of less than 1 dtex.

The loops or pile formed by fibers having a linear density greater than 1 dtex give abrasive or scraping power to said maintenance item for the purpose of detaching any dirt that might be located on the surface for cleaning.

The absorption power of the microfibers is such that if they constituted the entire cleaning surface, the maintenance item being handled remotely using a head-plate of a broom would adhere so strongly to the floor for cleaning, in particular when the maintenance item is wet, that the user would no longer be able to move said item (this can be referred to as the "suction cup" effect as generated by the capillary array).

To mitigate that drawback, scraping fibers having a linear density greater than 1 dtex are arranged in alternation with said microfibers. Since the scraping fibers have a linear density that is greater than that of the microfibers, they are stiffer and they form bearing points on the "cleaning" surface enabling the maintenance item to slide over the floor surface for cleaning.

Generally, such maintenance items include on their bottom surfaces—that are to form the "cleaning" surface that comes into contact with the floor—about 50% by weight of microfibers relative to the proportion by weight of fibers on said bottom faces, the remainder being formed by fibers having a linear density greater than 1 dtex.

Such maintenance items may be laminated with a foam or they may include other absorbent textile panels arranged on their top faces.

Such maintenance items are thus limited in the quantity of microfibers that their cleaning surfaces can present and also by their fineness (or linear density in dtex). The greater the fineness of the microfibers (i.e. the smaller their linear density (dtex)), the better they absorb liquids and recover dust present on the floor, but the greater their tendency to adhere to the cleaning surface on the floor.

Furthermore, since microfibers have capacities for absorption and recovery that are greater than those of the scraping fibers, it is advantageous to seek to optimize their quantity and/or their fineness in the cleaning surfaces of maintenance items.

DE 103 27 584 discloses a cleaning item having two portions in one of its faces. The fibers covering these sections present fineness in the range 0.1 dtex to 10 dtex, and preferably in the range 0.1 dtex to 3 dtex.

EP 0 925 399 discloses a textile structure comprising a support material from which there project fibers having different finenesses and thus capable of forming up to three different zones that repeat over the surface.

DESCRIPTION

Embodiments of the present disclosure mitigate the above-mentioned problems in full or in part in that, in a first aspect, it provides a maintenance item for cleaning a floor surface, the item comprising a front portion and a rear portion in line with each other, having respective top and bottom faces, said bottom faces defining a "cleaning" surface. The front portion includes, projecting from its bottom face, microfibers and scraping fibers of linear density greater than 1 dtex, and the rear portion includes, projecting from its bottom face, microfibers, and possibly also scraping fibers of linear density greater than 1 dtex. The mean linear density T1 (dtex) of the microfibers and of the scraping fibers on said bottom face of the front portion is greater than or equal to 0.5 dtex, whereas the mean linear density T2 (dtex) of the microfibers, and optionally of the scraping fibers, on said bottom face of the rear portion is less than or equal to 2 dtex, and the mean linear density T1 (dtex) is different from the mean linear density T2 (dtex).

The term "mean linear density" of the fibers present on the "cleaning" surface designates the weighted average of the linear densities of the various fibers.

The term "fiber" is used to designate a fiber or a filament.

The bottom faces of the front and rear portions are in line with each other equally.

The microfibers and the scraping fibers are preferably selected from the following polymers, singly or in combination: polyamide 6, polyamide 6-6, polyamide 4-6 or 12, polyethylene terephthalate, polypropylene, and polyethylene.

The microfibers preferably have a linear density of less than 1 dtex, preferably less than or equal to 0.87 dtex. The microfibers preferably have a linear density of 0.56 dtex or of 0.2 dtex. Preferably, when the microfibers have a linear density of 0.2 dtex, they comprise a mixture of polyethylene terephthalate fibers and of polyamide 6 or 6-6 fibers. This mixture is due in particular to their method of fabrication, which consists in extruding filaments presenting a pie segment structure, which segments are subsequently separated (the segments being made of polyethylene terephthalate, and the interfaces between two adjacent segments being made of polyamide).

The scraping fibers preferably have a linear density greater than 1 dtex, preferably greater than or equal to 4 dtex. More preferably, the scraping fibers have a linear density of 10 dtex or of 30 dtex.

Calculating the linear density of a fiber is well known to the person skilled in the art, and there exist numerous standards for performing this calculation, including in particular the following standards mentioned in non-exhaustive manner:

NF G01-001: Expression of linear density—TEX system;

NF EN ISO 1973: Determination of linear density—gravimetric method and vibroscope method;

ISO 7211-5: 1984: Woven fabrics, construction, methods of analysis, part 5: determination of linear density of yarn removed from fabric.

The values specified in the present text are given plus or minus 10%.

Advantageously, the front and rear portions have different capillary arrays, the maintenance article presenting adhesive powers on the floor cleaning surface that differ between the bottom face of the front portion and the bottom face of the rear portion, and thus presenting capacities for recovering and absorbing dirt that differ between these portions.

The linear density ranges specified for each of the portions give the bottom face of the front portion the function of sliding over the floor surface for cleaning. The bottom face of the front portion thus forms the "leading" face, i.e. the face from which the user causes the maintenance item to slide over the floor surface.

The inventors have thus observed, surprisingly, that the bottom face of the front portion unsticks dirt and recovers it by means of the microfibers it includes, and that the bottom face of the rear portion recovers even more dust and other dirt than does the front portion. This has been observed visually.

Furthermore, the user has no difficulty in causing the maintenance item to slide over the floor surface when beginning to move said item on its "cleaning" surface, i.e. the bottom face of the front portion.

The rear and front portions are connected together along one of their longitudinal edges, by any securing means known in the state of the art. The front and rear portions may, for example, be secured by stitching (e.g. whipping), ultrasound welding, or thermofusing.

The front and rear portions are constituted by a common textile panel, or preferably each of them is constituted by at least one textile panel, which may be woven or knitted, preferably being a weave or a knit including loops or pile projecting at least from their bottom surfaces forming the "cleaning" bottom surface.

The values specified concerning mean linear densities or indeed the proportions by weight of fibers are calculated relative to the fibers present on the bottom faces of the front and rear portions.

The maintenance item preferably includes an intermediate layer, e.g. made of one or more textile panels comprising microfibers or made of foam, arranged on the top faces of the front and rear portions that then form a bottom layer. The maintenance item may also include a top layer arranged on the intermediate layer, having attachment means suitable for co-operating with complementary attachment means arranged on the head-plate of a broom.

In a variant, the mean linear density T1 (dtex) is greater than the mean linear density T2 (dtex).

Advantageously, the bottom face of the rear portion has more microfibers than the bottom face of the front portion, and thus presents properties of absorbing and recovering dirt that are greater than those of the front portion.

The maintenance item of the present disclosure thus enables the effectiveness of cleaning to be improved.

In a variant, the bottom face of the rear portion comprises a proportion by weight of microfibers relative to the total weight of fibers projecting from the bottom face of the rear portion that is greater than the proportion by weight of microfibers of the bottom face of the front portion relative to the total weight of fibers projecting from the bottom face of the front portion.

In its bottom face, the rear portion includes fibers that are finer than the fibers of the bottom face of the front portion, thus enabling it to offer a capillary array that is more developed than that of the front portion.

In a variant, the microfibers and the scraping fibers on the bottom face of the front portion alternate repeatedly in at least one first given pattern, and the microfibers and optionally the scraping fibers on the bottom face of the rear portion alternate repeatedly in at least one second given pattern, and the first pattern being different from the second pattern.

This provision enhances sliding of the maintenance item over the floor surface to be cleaned.

The term "pattern" is used to designate any particular arrangement, in particular a geometrical arrangement, that is repeated over the bottom face of the maintenance item.

A first pattern may differ from a second pattern even though the arrangement of the loop is the same, providing the two patterns are visually different (it being possible to distinguish them because of the linear densities of the fibers, because of their color, and because of their arrangement on the bottom face of the front or rear portion). Under such circumstances, the rows of microfiber loops are visually different from the rows of scraping fiber loops because of the different linear densities of the fibers in question.

In a subvariant, the front portion and/or the rear portion may present on their bottom faces microfibers and/or scraping fibers that are arranged in at least two patterns.

For example, on its bottom face, the front portion may have a first strip of continuous rows of loops and/or of pile of scraping fibers making up a first pattern, followed by a second strip of continuous rows of loops and/or of pile of microfibers alternating with continuous rows of loops and/or of pile of scraping fibers, thereby forming a second pattern.

Under such circumstances, the rear portion preferably includes a strip of continuous rows of loops and/or of pile of microfibers forming a second pattern.

In a variant, the first and second patterns are selected from: alternating continuous or discontinuous rows of microfibers and/or of scraping fibers, zigzags of microfibers and/or of scraping fibers, and islands or localized zones of scraping fibers or of microfibers.

In a variant, the bottom faces of the front and rear portions comprise loops and/or free pile of microfibers and/or of scraping fibers.

In a variant, the bottom face of the rear portion comprises at least 80%, preferably at least 90%, by weight of microfibers relative to the total weight of fibers projecting from its bottom face.

The bottom faces of the front and rear portions of the maintenance item of the present disclosure thus makes it possible to present a large quantity of microfibers by weight, thereby optimizing the capacity of the maintenance item for absorbing and recovering dirt.

In a variant, the bottom face of the front portion comprises at least 50%, preferably at least 60%, by weight of microfibers relative to the total weight of fibers projecting from its bottom face.

In the prior art, a maintenance item for cleaning a floor surface generally comprises about 50% by weight of microfibers projecting from its bottom face, and sometimes 30% by weight relative to the total weight of fibers projecting from its bottom face.

The bottom faces of the front and rear portions of embodiments of the present disclosure thus preferably have at least 50%, preferably at least 60%, by weight of microfibers relative to the total weight of fibers projecting from said bottom faces. This provision thus improves cleaning effectiveness considerably.

In a variant, the maintenance item has attachment means suitable for co-operating with complementary attachment means arranged on the head-plate of a broom.

These attachment means may be side pockets suitable for co-operating with side ends of the head-plate of a broom, or they may be tongues arranged on the side edges of the maintenance item and projecting from the top faces of the front and rear portions in order to co-operate with eyelets, or other equivalent means arranged on the side ends of the head-plate of a broom. The attachment means may also be complementary magnet systems fitted to tongues arranged on the maintenance item and to the head-plate of the broom, or indeed attachment members of the hook and loop type suitable for co-operating together so as to be releasably secured to each other.

In a variant, the top faces of the front and rear portions are covered in a textile panel, in particular a three-dimensional knit, having loops with which hooks can co-operate in order to attach them. In particular, these may be hooks supported by the head-plate of a broom.

In a variant, the maintenance item includes a foam or a textile panel, comprising microfibers and arranged on the top face of the rear portion, and optionally of the front portion.

Said textile panel may be woven or knitted. Preferably, the foam or the textile panel thus forms an intermediate layer arranged on the top face of the front portion and possibly of the rear portion, and between them and an outer layer, said outer layer is preferably a three-dimensional knit and/or includes attachment means suitable for co-operating with attachment means fitted to the head-plate of a broom.

In a second aspect, the present disclosure also provides a cleaning device including a maintenance item in accordance with any of the above variant embodiments and comprising a broom fitted with a handle having a head-plate at its distal end and having dimensions that are of the same order as the dimensions of the maintenance item of the present disclosure.

The maintenance item and thus the head-plate for receiving it may be rectangular or trapezoidal in shape. Mode(s) for carrying out the embodiments of the present disclosure.

The present disclosure can be better understood on reading about three embodiments mentioned in a non-limiting manner. In the following embodiments, the percentages by weight of fibers in the bottom face of the front or rear portion are given relative to the total weight of the fibers projecting from said bottom face of the front or rear portion.

The first example of a maintenance item has a front portion and a rear portion in line with each other and having respective top and bottom faces, said bottom faces defining a "cleaning" surface, the front portion including on its bottom face microfibers and scraping fibers having a linear density greater than 1 dtex, and the rear portion having microfibers on its bottom face. The mean linear density T1 (dtex) of microfibers and scraping fibers on said bottom face of the front portion is greater than or equal to 0.5 dtex, the mean linear density T2 (dtex) of microfibers on said bottom face of the rear portion is less than or equal to 2 dtex, and the mean linear density T1 (dtex) is greater than or equal to the mean linear density T2 (dtex). The front portion is a warp and weft pile fabric having alternating microfibers and scraping fibers projecting from its bottom face and each arranged in a first pattern, e.g. the microfibers and the scraping fibers alternate in the form of islands. The front portion thus has microfiber pile and scraping fiber pile. The bottom face of the rear portion, in particular a warp knitted fabric with loops is constituted by microfibers, preferably of the pie segment type in a 70%/30% (by weight) mixture of polyethylene terephthalate/polyamide, with a linear density of 0.2 dtex. The microfibers are arranged in continuous rows of loops and thus form a second pattern different from the first pattern.

In its bottom face, the front portion has 90% by weight of microfibers. The scraping fibers represent 10% by weight of the surface of the front portion. The microfibers of the front portion have a linear density of 0.56 dtex and they are preferably made of polyethylene terephthalate. The scraping fibers of the front portion have a linear density of 30 dtex and they are preferably made of polyamide. Thus, the mean linear density (T1) of the front portion is equal to (0.9×0.56 dtex+0.1×30 dtex=) 3.5 dtex, while the mean linear density (T2) of the rear portion is (1×0.2 dtex=) 0.2 dtex.

The rear portion thus presents a mean linear density (T2) that is much less than the mean linear density (T1) of the front portion, thereby giving the front portion the main function of scraping the floor in order to unstick dirt and the function of sliding, and on the rear portion the function of absorbing and recovering dirt, some of which has been unstuck but not absorbed by the front portion.

The second embodiment of a maintenance item differs from the first embodiment in that the rear portion comprises a warp knitted fabric with loops comprising alternating loops of microfibers and loops of scraping fibers projecting from its bottom and alternating in a second pattern, e.g. intervals comprising a plurality of rows of microfibers or of scraping fibers, the second pattern being different from said first pattern.

In this particular embodiment, the microfibers and the scraping fibers represent respectively 80% by weight and 20% by weight of the bottom surface of the front portion, and they have respective linear densities of 0.87 dtex and 5 dtex. In the bottom face of the rear portion, the proportion by weight of microfibers is greater than that in the bottom face of the front portion since it represents 90% by weight of the bottom surface of the rear portion, thus leaving 10% scraping fibers. In the bottom face of the rear portion, the microfibers have a linear density of 0.2 dtex and the scraping fibers have a linear density of 4 dtex. The mean linear density (T1) of the fibers in the bottom face of the front portion is thus about 1.69 dtex (=0.8×0.87 dtex+0.2×5 dtex). The mean linear density (T2) of the fibers in the bottom face of the rear portion is 0.58 dtex (=0.9×0.2 dtex+0.1×4 dtex).

The third embodiment of a maintenance item has a front portion in a warp and weft knitted fabric having loops, with 50% by weight microfibers and 50% by weight scraping fibers. The rear portion is likewise a warp and weft knitted fabrics having loops, with 80% by weight microfibers and 20% by weight scraping fibers. In the front and rear portions, the microfibers are preferably of the pie segment type in a 70%/30% (by weight) mixture of polyethylene terephthalate/polyamide, and they have a linear density of 0.2 dtex, while the scraping fibers are preferably made of polyethylene terephthalate and have a linear density of 4 dtex.

The mean linear density (T1) of fibers in the bottom face of the front portion is thus 2.1 dtex (=0.5×0.2 dtex+0.5×4 dtex). The mean linear density (T2) of fibers in the bottom face of the rear portion is 1.248 dtex (=0.8×0.2 dtex+0.2×4 dtex).

The three above-mentioned embodiments all have the advantage of presenting a bottom face of the rear portion with properties that are improved in terms of absorbing liquids and recovering dirt compared with the properties provided by the bottom face of the front portion, which serves to improve the quality with which a floor surface is cleaned while preserving the comfort of the user handling said maintenance item at a distance via the head-plate of a broom, for example.

Where any standards of national, international, or other standards body are referenced (e.g., ISO, etc.), such references are intended to refer to the standard as defined by the national or international standards body as of the priority date of the present specification. Any subsequent substantive changes to such standards are not intended to modify the scope and/or definitions of the present disclosure and/or claims.

The invention claimed is:

1. A maintenance item for cleaning a floor surface, the item comprising:

a knit or weave component comprising:

a front knit or weave portion and a rear knit or weave portion in line with each other and defining an axis A along the line separating the front portion and the rear portion, each portion having a top face and a bottom face, said bottom faces defining a cleaning surface, wherein the front knit or weave portion includes, projecting from its bottom face, both microfibers and scraping fibers, both the scraping fibers and the microfibers projecting from the bottom face of the front knit or weave portion, and the front knit or weave portion being of unitary knit or weave construction with the knit or weave component, such that the front knit or weave portion, the microfibers and the scrapping fibers, and also the knit or weave component comprise a one piece element, and the rear knit or weave portion includes, projecting from its bottom face, both microfibers and scraping fibers, both the scraping fibers and the microfibers projecting from the bottom face of the rear knit or weave portion, and the rear knit or weave portion being of unitary knit or weave construction with the knit or weave component, such that the rear knit or weave portion, the microfibers and the scrapping fibers, and the knit or weave component comprise the one piece element, and wherein the cleaning surface is comprised of the microfibers and the scraping fibers projecting from the bottom face of the rear portion, and the microfibers and the scraping fibers projecting from the bottom face of the front portion, wherein the linear density of the scraping fibers on the bottom face of the front portion, and on the bottom face on the rear portion, is greater than 1 dtex, the mean linear density T1 (dtex) of both the microfibers and the scraping fibers on said bottom face of the front knit or weave portion is greater than or equal to 0.5 dtex, and the mean linear density T2 (dtex) of both the microfibers and the scraping fibers on said bottom face of the rear knit or weave portion is less than or equal to 2 dtex, wherein the mean linear density T1 (dtex) is different from the mean linear density T2 (dtex), and wherein the item has a floor-surface-cleaning direction F that is approximately perpendicular to the axis A and that intersects the front portion and the rear portion, the bottom face of the front portion being the leading face when the user causes the maintenance item to slide over the floor surface in the floor-surface-cleaning direction F, wherein the maintenance item is arranged to cooperate with a handle having a longitudinal axis B and having a head-plate at its distal end that attaches to the maintenance item, wherein the longitudinal axis B of the handle intersects the axis A when the head-plate is attached to the maintenance item, and wherein the bottom face of the rear portion comprises a proportion by weight of microfibers relative to the total weight of fibers projecting from the bottom face of the rear portion that is greater than the proportion by weight of microfibers of the bottom face of the front portion relative to the total weight of fibers projecting from the bottom face of the front portion.

2. A maintenance item according to claim 1, wherein the mean linear density T1 (dtex) is greater than the mean linear density T2 (dtex).

3. A maintenance item according to claim 1, wherein the microfibers and the scraping fibers on the bottom face of the front portion alternate repeatedly in a first given pattern, and wherein the microfibers and the scraping fibers on the bottom face of the rear portion alternate repeatedly in a second given pattern, and wherein the first pattern is different from the second pattern.

4. A maintenance item according to claim 3, wherein in that the first and second patterns are selected from: alternating continuous or discontinuous rows of microfibers and/or of scraping fibers, zigzags of microfibers and/or of scraping fibers, and islands or localized zones of scraping fibers or of microfibers.

5. A maintenance item according to claim 1, wherein the bottom face of the rear portion comprises at least 80% by weight of microfibers relative to the total weight of fibers projecting from the bottom face of the rear portion.

6. A maintenance item according to claim 5, wherein the bottom face of the rear portion comprises at least 90% by weight of microfibers relative to the total weight of fibers projecting from the bottom face of the rear portion.

7. A maintenance item according to claim 1, wherein the bottom face of the front portion comprises at least 50% by weight of microfibers relative to the total weight of fibers projecting from the bottom face of the front portion.

8. A maintenance item according to claim 7, wherein the bottom face of the front portion comprises at least 60% by weight of microfibers relative to the total weight of fibers projecting from the bottom face of the front portion.

9. A maintenance item according to claim 1, further comprising:

a foam panel or a textile panel, comprising microfibers and arranged on the top face of the rear portion.

10. A maintenance item according to claim 9, further comprising:

the foam panel or the textile panel, comprising microfibers and arranged on the top face of the rear portion and on the top face of the front portion.

11. A cleaning device including a maintenance item according to claim 1, further comprising:

a broom comprising the handle with the head-plate at its distal end, wherein the head-plate is of dimensions that are of the same order as the dimensions of the maintenance item.

12. A cleaning device according to claim 11, wherein the maintenance item includes attachment means suitable for co-operating with complementary attachment means arranged on the head-plate of said broom.

13. A maintenance item for cleaning a floor surface, the item comprising:

a knit or weave component comprising:

a front knit or weave, portion and a rear knit or weave portion in line with each other and defining an axis A along the line separating the front portion and the rear portion, each portion having a top face and a bottom face, said bottom faces defining a cleaning surface;

wherein the front knit or weave portion includes, projecting from its bottom face, both microfibers and scraping fibers, both the scraping fibers and the microfibers projecting from the bottom face of the front knit or weave portion, and the front knit or weave portion being of unitary knit or weave construction with the knit or weave component, such that the front knit or weave portion, the microfibers, and the scrapping fibers, and also the knit or weave component comprise a one piece element, and the rear knit or weave portion includes, projecting from its bottom face, only microfibers, the microfibers projecting from the bottom face of the rear knit or weave portion, and the rear knit or weave portion being of unitary knit or weave, construction with the knit or weave component, such that the rear knit or weave portion, the microfibers, and the knit or weave component comprise the one piece element, and wherein the cleaning surface is comprised of the microfibers projecting from the bottom face of the rear portion, and the microfibers and the scraping fibers projecting from the bottom face of the front portion, wherein the linear density of the scraping fibers on the bottom face of the front portion is greater than 1 dtex, wherein the mean linear density T1 (dtex) of both the microfibers and the scraping fibers on said bottom face of the front knit or weave portion is greater than or equal to 0.5 dtex, and the mean linear density T2 (dtex) of the microfibers on said bottom face of the rear knit or weave portion is less than or equal to 1 dtex; and wherein the mean linear density T1 (dtex) is different from the mean linear density T2 (dtex), wherein the item has a floor-surface-cleaning direction F that is approximately perpendicular to the axis A and that intersects the front portion and the rear portion, the bottom face of the front portion being the leading face when the user causes the maintenance item to slide over the floor surface in the floor-surface-cleaning direction F, wherein the maintenance item is arranged to cooperate with a handle having a longitudinal axis B and having a head-plate at its distal end that attaches to the maintenance item, wherein the longitudinal axis B of the handle intersects the axis A when the head-plate is attached to the maintenance item, and wherein the bottom face of the rear portion comprises a proportion by weight of microfibers relative to the total weight of fibers projecting from the bottom face of the rear portion that is greater than the proportion by weight of microfibers of the bottom face of the front portion relative to the total weight of fibers projecting from the bottom face of the front portion.

14. A maintenance item according to claim 13, wherein the mean linear density T1 (dtex) is greater than the mean linear density T2 (dtex).

15. A maintenance item according to claim 13, wherein the bottom face of the rear portion comprises a proportion by weight of micro fibers relative to the total weight of fibers projecting from the bottom face of the rear portion that is greater than the proportion by weight of microfibers of the bottom face of the front portion relative to the total weight of fibers projecting from the bottom face of the front portion.

16. A maintenance item according to claim 13, wherein the bottom face of the front portion comprises at least 50% by weight of microfibers relative to the total weight of fibers projecting from the bottom face of the front portion.

17. A maintenance item according to claim 16, wherein the bottom face of the front portion comprises at least 60% by weight of microfibers relative to the total weight of fibers projecting from the bottom face of the front portion.

18. A maintenance item according to claim 13, further comprising:

a foam panel or a textile panel, comprising microfibers and arranged on the top face of the rear portion and on the top face of the front portion.

19. A cleaning device including a maintenance item according to claim 13, further comprising:

a broom comprising the handle with the head-plate at its distal end, wherein the head-plate is of dimensions that are of the same order as the dimensions of the maintenance item.

* * * * *